US007637356B2

(12) United States Patent
Kocher

(10) Patent No.: US 7,637,356 B2
(45) Date of Patent: Dec. 29, 2009

(54) ELEVATOR SYSTEM WITH SAFETY DEVICE ON ELEVATOR DOORS

(75) Inventor: Hans Kocher, Udligenswil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/904,789

(22) Filed: Sep. 28, 2007

(65) Prior Publication Data

US 2008/0078626 A1 Apr. 3, 2008

(30) Foreign Application Priority Data

Sep. 28, 2006 (EP) ..... 06121446

(51) Int. Cl.
*B66B 13/18* (2006.01)

(52) U.S. Cl. ..... 187/330; 187/335

(58) Field of Classification Search ..... 187/330, 187/331, 335

See application file for complete search history.

(56) References Cited

U.S. PATENT DOCUMENTS 1,838,524 A * 12/1931 Brown ..... 187/330
5,246,089 A 9/1993 Husmann et al.
5,377,785 A 1/1995 Pearson
5,819,877 A 10/1998 Rivera et al.
2003/0070882 A1 4/2003 Lauch

FOREIGN PATENT DOCUMENTS

| | | |
|---|---|---|
| EP | 0513509 | 11/1992 |
| EP | 0634353 | 1/1995 |
| FR | 2 815 951 | 5/2002 |
| JP | 53-47652 | * 4/1978 |
| JP | 04080191 | 3/1992 |

* cited by examiner

*Primary Examiner*—Thomas J. Brahan
(74) *Attorney, Agent, or Firm*—Wolff & Samson, PC

(57) ABSTRACT

In an elevator system that has an elevator hoistway, a plurality of hoistway doors arranged above each other each with at least one horizontally moveable hoistway door panel, and an elevator car with a car door that has at least one horizontally movable car door panel, fastened to the car door panel is a vertically extending barrier rail. In each of the areas lying in the vertical direction between the hoistway door panels of adjacent hoistway doors two locationally fixed stopping dogs that are vertically spaced from each other are arranged so that in each case one of the stopping dogs limits the opening movement of the barrier rail, and thereby of the car door panel, when the position of the elevator car deviates in the upward direction or in the downward direction by a certain minimum distance from the intended stopping position.

8 Claims, 3 Drawing Sheets

Fig. 3 (Section III-III)

(Section V-V)

ELEVATOR SYSTEM WITH SAFETY DEVICE ON ELEVATOR DOORS

BACKGROUND OF THE INVENTION

The present invention relates to an elevator system that comprises a plurality of hoistway doors arranged above each other that have horizontally movable hoistway door panels, as well as to an elevator car with a car door that has at least one horizontally movable car door panel. Stopping means that are arranged locationally fixed in the elevator hoistway act in conjunction with a stopping means that is fastened to the car door panel to limit an opening movement of the car door panel on occurrence of certain deviations of the stationary position of the elevator car from the intended stopping position.

Hereinafter, "intended stopping position" is to be understood as that position of the elevator car at which the level of its car floor exactly matches the level of that story in whose vicinity the elevator car is present at that time.

From JP04080191A an elevator system is known that comprises a safety device with the above mentioned characteristics. Present in this elevator system on the car door panel is a coupling element that projects in the direction of the door-side wall of the elevator hoistway that couples the car door panel with an oppositely situated hoistway door panel when the elevator car is sufficiently accurately present at a hoistway door level or story level. In each case, between vertically adjacent hoistway doors a vertically aligned stopping plate is fastened to the door-side inside wall of the elevator hoistway. This limits an opening movement of the coupling element that is fastened to the hoistway door panel, and thereby of the hoistway door panel itself, when the elevator car has stopped so far below the intended stopping position that is assigned to a hoistway door that the horizontal projections of the coupling element and of the stopping plate mutually overlap. The purpose of the safety device according to JP04080191A is to make the large and costly safety aprons that are fastened below the door sill of every hoistway door superfluous. Such safety aprons prevent a passenger from being able to fall into the space that is present between elevator car and door-side hoistway wall after the passenger has opened the car door of the car that is standing stationary below the intended stopping position.

In the elevator system according to JP04080191A, in the case of an elevator car that is standing too low, falling of a passenger into the space between elevator car and hoistway wall is indeed prevented when the elevator car has stopped at a level that is too low. Not prevented or limited, however, is opening of the car door and hoistway door when the elevator car is standing too far above the intended stopping position. In this situation, there is the danger that a passenger who attempts to exit from the car floor onto the hoistway floor falls through the hoistway door opening that is present below the car door sill and into the open elevator hoistway. Such a fall into the elevator hoistway could indeed be prevented by a sufficiently high safety apron that is fastened to the car door sill of the elevator hoistway and extends at least one meter downwards from there. However, such a safety apron requires a correspondingly deep hoistway pit below the level of the lowest hoistway door, which in certain constructional situations cannot be realized, or at the least causes substantial additional costs. In addition, the solution according to JP04080191A requires relatively long stopping plates in each space between vertically adjacent hoistway doors, the stopping plates needing to be fastened and aligned on the door-side hoistway wall with considerable outlay. It is also disadvantageous that in elevator systems with different distances between the stories, the lengths of the stopping plates must be adapted to the story distances.

In elevator systems in which over relatively large distances—for example over several story heights—no hoistway doors are present, a stopping plate must be installed that extends over the entire distance.

SUMMARY OF THE INVENTION

The object of the invention is to provide an elevator system with a safety device of the type described above that does not possess the mentioned disadvantages. In particular, an elevator system should be created in which the safety of passengers is assured even when the elevator car has stopped too far above the intended stopping position. However, for the reasons stated above, a high safety apron fastened below the car door sill should be obviated. Furthermore, the proposed solution should be realizable with low outlay for material and installation, different story distances not requiring different components of the safety device.

The object is fulfilled by an elevator system according to the invention that comprises an elevator hoistway, a plurality of hoistway doors arranged above each other, each of which has at least one horizontally movable hoistway door panel, and an elevator car with a car door that has at least one horizontally movable car door panel. A vertically extending barrier rail as stopping means is mounted on the car door panel and in each case two locationally fixed stopping dogs that are vertically spaced from each other are fastened at such a height between the door panels of vertically adjacent hoistway doors that in each case one of the stopping dogs limits the horizontal opening movement of the barrier rail and thereby the car door panel when the position of the elevator car deviates in positive or negative vertical direction, i.e. in upward direction or in downward direction, by a defined minimum distance from the intended stopping position.

The advantages derived from the invention are essentially the following:

- in case of an unforeseen halt of the elevator car outside the intended stopping position when the elevator car is standing too low, the elevator passengers are protected not only from falling into the space between elevator car and door-side hoistway wall but also from the danger of falling onto the story floor in the vicinity of the hoistway door sill and from there into the open elevator hoistway. This danger is present if a passenger can open the elevator doors after the elevator car has stopped too far above the intended stopping position.
- A safety apron with a height of more than 150 mm that is fastened below the car door sill can be obviated, which enables the realization of a hoistway pit with shallow depth.
- The safety device is realizable with little outlay for material and installation, since only one single stopping means, the barrier rail on the car door, with a length of more than 1 m, is required, and the other stopping means, the locationally fixed stopping dogs, have only short lengths, typically less than 50 mm. The stopping dogs are therefore easier to install, since it is essentially only necessary to ensure their correct position and not their exact vertical alignment.
- Even with different story distances and relatively long hoistway sections without hoistway doors, uniform locationally fixed stopping means (stopping dogs) of uniform length can be used.

Advantages when evacuating passengers from elevator cars that are blocked too far away from an intended stopping position are brought by an embodiment of the invention in which the stopping dogs are arranged offset so far from the barrier rail in the direction of opening of the car door panel that a limitation of the opening movement only occurs when a car door gap of at least 30 mm is present.

By this means, in the mentioned situation, the at least one car door panel, and by the maintenance personnel, also the assigned hoistway door panel, can be opened as far as a door gap width that still assures safety so that the maintenance personnel can inform the trapped passengers about the procedure for the foreseen evacuation and, for example, supply them with refreshments.

According to a preferred embodiment of the invention, the locationally fixed stopping dogs are fastened on locationally fixed elements of the hoistway doors, for example on the hoistway door sills, on the door headers, or on cladding elements. As a consequence, the stopping means need not be fastened during installation to the hoistway wall, whose position relative to the hoistway doors and the car door can vary greatly. Elaborate drilling and alignment work during installation can thereby be avoided.

Advantageously, the stopping dogs are so placed that a hoistway door in front of which the elevator car takes up a position, in which a stopping dog prevents the complete opening movement of the barrier rail and of the car door panel, can be completely opened by maintenance personnel on condition that the elevator car is standing so far from the intended stopping position that the cam device is no longer engaged between the car door panel and the hoistway door panel. Through the completely opened hoistway door, when the elevator car is blocked, and the car door panel is blocked, maintenance personnel have, for example, access to the car door drive, to the car roof, or to elevator components that are present under the elevator car. The coupling device mentioned above is to be understood as a coupling device via which, on occurrence of a story stop of the elevator car, the hoistway door panel is unlocked and opened or closed from the car door panel but whose function (engagement) is only given within a limited zone in the area of the intended stopping position.

With the elevator system according to the invention, particularly major advantages with respect to manufacturing costs and installation outlay result from all stopping dogs having unchanged dimensions even with different story heights and door heights.

Advantageously, the height of the locationally fixed stopping dog is not more than 50 mm. Alignment work during installation, as well as material costs and transport weight, are thereby minimized.

In the elevator system according to the invention, the length of the barrier rail can be determined very easily. This is always equal to the height of the hoistway door panel less the sum of the permissible upward and downward deviations of the actual position of the elevator car from its intended stopping position. A barrier rail that is designed according to this rule has the minimum length at which the foreseen functions of the safety device are still realizable.

To avoid major damage to the elevator system should the elevator car execute a vertical movement as a result of a control fault with incompletely closed car doors and collide with one of the stopping dogs, the locationally fixed stopping dogs are fastened in such manner, for example on locationally fixed elements of the hoistway door, that they can be moved vertically under the influence of a certain vertical force.

Significant savings in installation and alignment work can be achieved through the barrier rail and/or the stopping dog being already installed on the car door panel or on elements of the hoistway doors when the elevator system is delivered.

In the case of elevator systems in which over a relatively large distance—for example several story heights—for at last one of possibly several car doors no corresponding hoistway door is present, in the corresponding hoistway-door-free zones instead of a continuous stopping plate as required in the prior art, a number of stopping dogs are to be fastened along the door-side hoistway wall at distances that correspond to, at the most, the length of the barrier rail. Also by this means, significant costs can be saved.

Other features and advantages of the present invention will become apparent from the following description of the invention that refers to the accompanying drawings.

BRIEF DESCRIPTION OF THE DRAWINGS

FIG. 3 shows a horizontal section through a car door/hoistway door arrangement of the elevator system shown in FIG. 2.

DETAILED DESCRIPTION OF THE INVENTION

Figure 1:
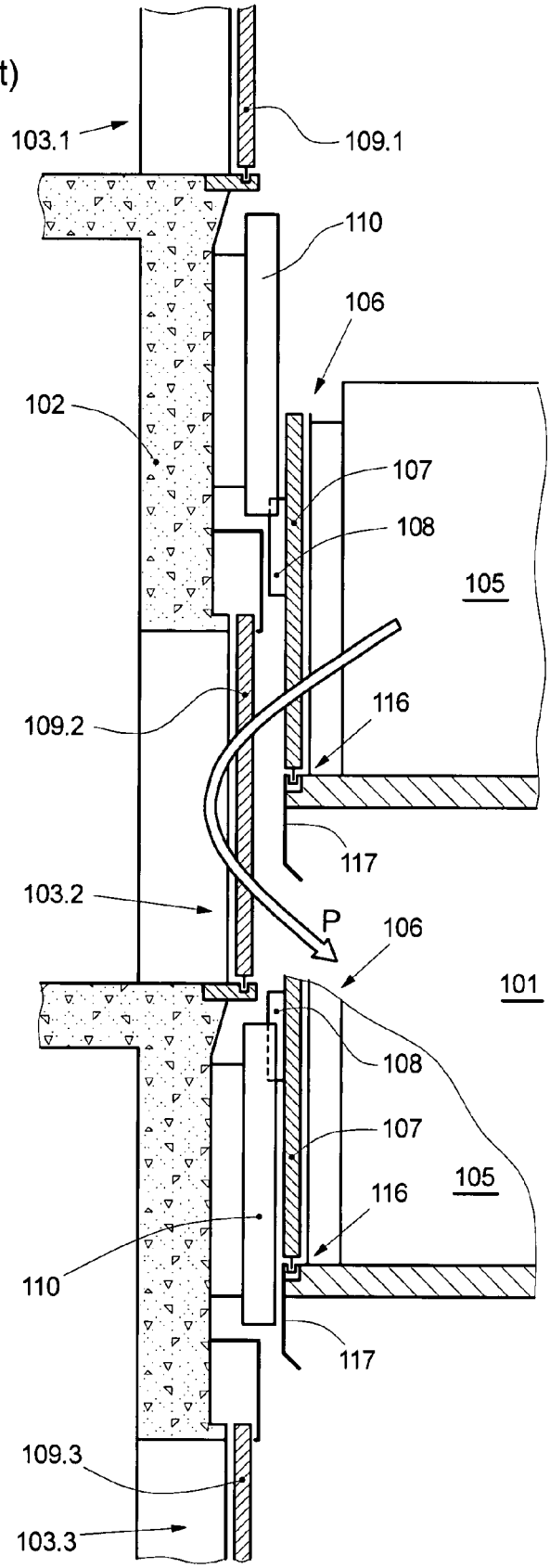
Fig. 1 (Prior Art)
FIG. 1 shows diagrammatically a vertical section through an elevator system according to the known prior art. The elevator car is shown in two positions that deviate upwards and downwards from the intended stopping position that is assigned to a hoistway door.

FIG. 1 shows diagrammatically a vertical section through an elevator system according to the aforesaid prior art. Shown are a door-side hoistway wall 102 of an elevator hoistway 101 with three hoistway doors 103.1-103.3 arranged above each other and an elevator car 105 in two positions that deviate greatly from the intended stopping position that is assigned to the middle hoistway door 103.2. The elevator car 105 comprises a car door 106 with a car door panel 107 on which an engagement element 108 is mounted that, on opening of the door in normal operation, couples the car door panel 107 with one of the hoistway door panels 109.1-109.3. In the areas situated between the hoistway doors 103.1-103.3 that are arranged above each other, vertically aligned stopping plates 110 are mounted so that they prevent, or at least limit, an opening movement of the engagement element 108, and thereby of the car door panel 107, when the elevator car 105 is positioned too far below the intended stopping position that is assigned to a hoistway door 103.1-103.3, as is the case in the lower of the positions of the elevator car 105 shown in FIG. 1.

According to the description of this prior art, the purpose of the described device is to prevent a passenger from being able to fall into the open space that is present between the elevator car 105 and the door-side hoistway wall 102 when the elevator car 105 is standing below an intended stopping position that is assigned to a hoistway door and the passenger opens the car door. The disclosed device cannot, however, prevent a passenger, for example when attempting to leave the elevator car 105 that is standing relatively far above the intended stopping position assigned to the hoistway door 103.2, from falling through the opened car door 106 and the opened hoistway door 103.2 into the elevator hoistway. The arrow P that is assigned to the upper of the positions of the elevator car 105 that are shown in FIG. 1 shows the possible path of such a fall. This risk of falling could, in fact, be eliminated by an especially high safety apron 117 mounted below the car door sill 116, which would, however, be associated with the severe disadvantage that the hoistway pit of the elevator hoistway would have to be executed correspondingly deep.

Figure 2:
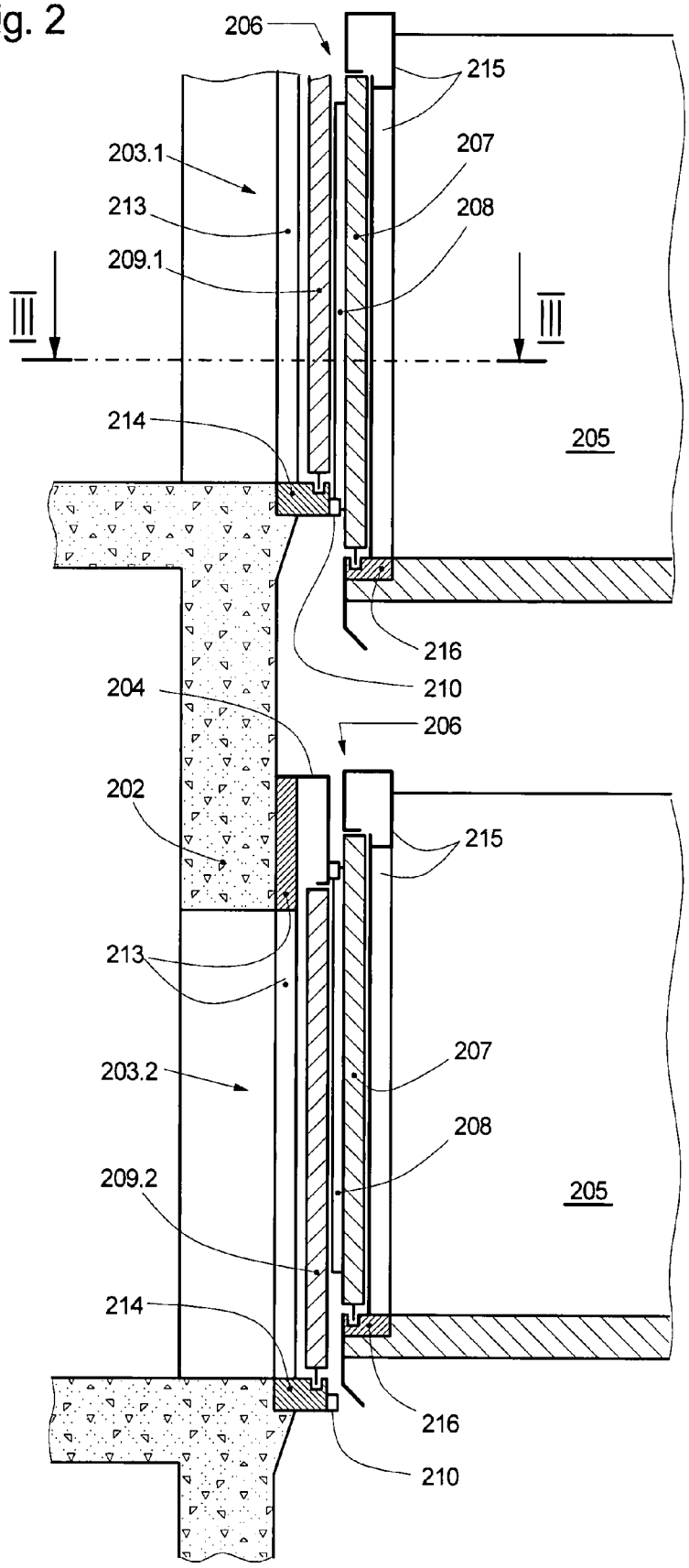
FIG. 2 shows diagrammatically a vertical section through an elevator system according to the invention. The elevator car is shown in two positions that deviate upwards and downwards from an intended stopping position that is assigned to a hoistway door.

FIG. 2 shows diagrammatically a vertical section through the door-side hoistway wall 202 of an elevator system with two vertically adjacent hoistway doors 203.1, 203.2, and through an elevator car 205 that is shown in two different vertical positions. The hoistway doors 203.1, 203.2, each contain at least one hoistway door panel 209.1, 209.2, that is guided in a horizontally movable-manner on a hoistway door frame 213 that contains a hoistway door sill 214. The car door 206 contains at least one car door panel 207 that is guided in a horizontally movable manner on a car door frame 215 that contains a car door sill 216. The car door panel 207 is opened and closed by a not-shown door drive. Fastened on the car door panel and also not shown in this view is a coupling device via which the hoistway door panel 209.1, 209.2 is unlocked and opened or closed from the car door panel 207 when the elevator car stops at a story.

The elevator car 205 is shown in the upper part of FIG. 2 in a stopped position that is below one of the intended stopping positions that is assigned to the upper hoistway door 203.1. Shown in the lower part of FIG. 2 is the elevator car 205 in a stopped position that is above the intended stopping position that is assigned to the lower hoistway door 203.2. In both of the stopping positions shown, their distance from the intended stopping position is so great that, for the safety reasons described above, an opening of the car door panel 207 must be limited, which in the case of the elevator system according to the invention is achieved with the aid of the safety device described below.

Fastened onto the car door panel 207, and extending vertically over a large part of its height, is a barrier rail 208. This projects from the hoistway-door-side surface of the car door panel 207 so far into the gap that is present between the car door panel 207 and the hoistway door panel 209.1, 209.2 that it forms a sufficiently wide vertical stopping surface via which a locationally fixed stopping dog 210 can block the opening movement of the car door panel 207. Two such respective locationally fixed stopping dogs 210 are arranged at a vertical distance from each other in all areas of an elevator system according to the invention between two respective vertically adjacent hoistway doors 203.1, 203.2. These locationally fixed stopping dogs 210 are preferably placed in such manner that in the vertical direction they lie as near as possible under the lower edge of the respective upper hoistway door panel 209.1 and above the upper edge of the respective lower hoistway door panel 209.2, so that their joint vertical projection in the direction of opening of the car door panel lies at a defined distance from that of the barrier rail 208. The stopping dogs 210 project so far over the car-door-side surface of the hoistway door panel 209.1, 209.2 that they do not reach the hoistway-door-side surface of the car door panel 207 (see also FIG. 3). In this arrangement, the stopping dogs 210 are able to stop the barrier rail 208; and thereby also the car door panel 207, should the elevator car 205 be so far above or below the intended stopping position that, after a limited opening movement of the car door panel 207, the barrier rail 208 collides with one of the locationally fixed stopping dogs 210. The length of the limited opening movement is determined by the distance stated above, that is present in the opening direction of the car door panel between the barrier rail 208 and the locationally fixed stopping dogs 210. This distance is preferably selected so that the opening path of the car door panel or panels is only limited at a car door gap of at least 30 mm, when the elevator car is positioned too far from the intended stopping position.

As shown in FIG. 2, the locationally fixed stopping dogs 210 are preferably fastened to locationally fixed elements of the hoistway doors 203.1, 203.2, for example to the hoistway door sills 214, to elements of the hoistway door frame 213, or to cladding elements 204 of the hoistway doors.

The locationally fixed stopping dogs 210 are placed outside the space that is occupied by the hoistway door panels 209.1, 209.2 so that these can be completely opened, even though the elevator car 205 takes up a position in front of a hoistway door in which a stopping dog 210 limits the opening movement of the barrier rail 208 and thereby of the car door panel 207. Prerequisite for the complete opening of the hoistway door panel in this situation is, however, that as a result of a relatively large deviation of the car position from its intended stopping position, the coupling device 218 (see FIG. 3) that couples the car door panel with the hoistway door panel in the area of the intended stopping position of the elevator car is no longer engaged.

From FIG. 2 it is apparent that—different from the stopping plates according to the prior art—the locationally fixed stopping dog 210 always have unchanged dimensions even with different story heights and door heights. The height of the stopping dog is preferably not more than 50 mm. The outlay for material and installation is thereby reduced and the necessary material logistics are correspondingly simplified.

From FIG. 2, determination of the minimum required length of the barrier rail 208 can be very easily deduced. This is always equal to at least the height of the hoistway door panel 209.1, 209.2 less the sum of the permissible upward and downward deviations of the actual position of the elevator car from its intended stopping position. Use of this rule for determination of the length of the barrier rail 208 ensures that the intended functions of the safety device are realizable with smallest possible length of the barrier rail.

FIG. 3 shows diagrammatically a horizontal cross section III-III through a car door/hoistway door arrangement of the elevator system shown in FIG. 2. Visible are the door-side hoistway wall 202, two horizontally movable hoistway door panels 209.1 with the hoistway door sill 214 situated below, two car door panels 207 that correspond with the hoistway door panels with the car door sill 216 situated below, as well as a part of the elevator car 205. Indicated with 208 are two vertically—i.e. perpendicular to the surface of the drawing—extending barrier rails of which each is fastened to one of the car door panels 207. Fastened in locationally fixed manner on the hoistway door sill 214 and arranged offset relative to the barrier rails 208 by a certain distance in the opening direction of the door panel are two stopping dogs 210 through which the opening path of the barrier rail 208 and thereby of the car door panel 207 is limited, when the elevator car is situated too far below the intended stopping position that is assigned to the hoistway door. The opening path that is still executable in this situation results in a door gap width that is still sufficiently narrow to prevent passengers from falling into the elevator hoistway but which nonetheless allows communication between maintenance personnel and trapped passengers as well as, for example, to supply the passengers with refreshments. Also drawn diagrammatically in FIG. 3 are two coupling devices 218 that are arranged between respective corresponding car door panels and hoistway door panels and mentioned in association with FIG. 2 that transmit the door movements of the motor-driven car door panels 207 to the hoistway door panels 209.1.

Figure 4:
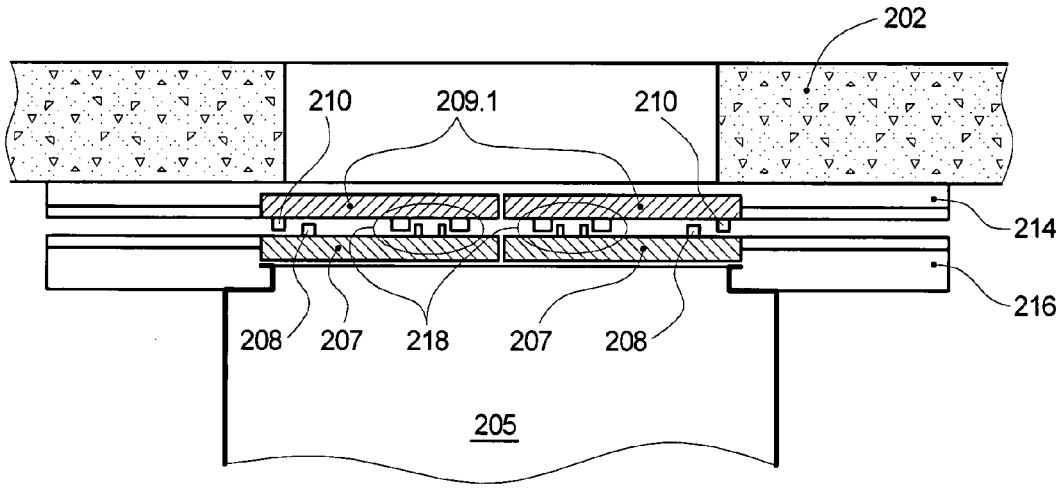
FIG. 4 shows the fastening of a stopping dog on the hoistway door sill of an elevator system according to the invention.
Figure 5:
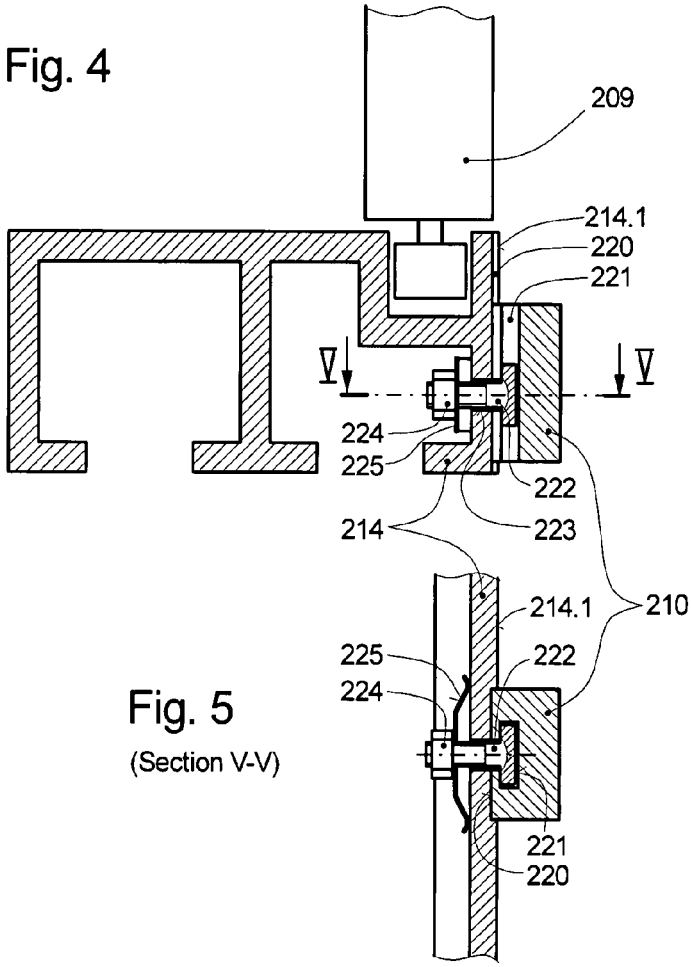
FIG. 5 shows a horizontal section through the fastening according to FIG. 4.

Shown in FIGS. 4 and 5 (Section V-V) is an advantageous embodiment of the fastening of a stopping dog 210 onto a hoistway door sill 214 that guides a hoistway door panel 209. A block-shaped stopping dog 210 is guided in an approximately 1 mm deep vertical groove 220 in the front wall 214.1 of the hoistway door sill 214. The stopping dog 210 is provided with a T-shaped T-groove 221 that runs continuously in the vertical direction. Inserted in this T-groove 221 is a special bolt 222 with a bolt head of least possible height that is adapted to the T-groove and whose bolt shank is inserted through a drilled hole 223 in the front wall 214.1 of the hoistway door sill 214. By means of a self-locking threaded nut 224 and a leaf spring 225, the special bolt 222 and with it the stopping dog 210 is fastened to the hoistway door sill 214. In the shown fastening, thanks to being guided in the horizontal direction in the vertical groove 220, i.e. in the direction in which the barrier rail 208 acts on it in the normal case, the stopping dog 210 is capable of bearing a heavy load. Under the influence of a vertical force, the stopping dog 210 can, however, be pressed out from its fastening along the vertical groove, the necessary vertical force depending on the pretensioning force of the leaf spring 225. This way of fastening the stopping dogs can be of great advantage if, as a result of faulty functioning of the elevator control when the elevator car 205 is moving vertically and the car door panel 207 is at least partly open, the barrier rail 208 strikes against one or more of the stopping dogs 210. Thanks to the embodiment of the stopping dog fastening that is shown, major damage of the elevator system can be avoided.

A correspondingly adapted fastening of the stopping dog to elements of the hoistway door 203.1, 203.2, for example to the door header of the hoistway door frame 213 or to cladding elements 204 of the hoistway door, is self-evidently also realizable.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. An elevator system, comprising:

an elevator hoistway;

a plurality of hoistway doors arranged above each other each with at least one horizontally moveable hoistway door panel;

an elevator car with a car door that has at least one horizontally movable car door panel;

a vertically extending barrier rail fastened to the car door panel; and, two locationally fixed stopping dogs in areas lying in a vertical direction between the hoistway door panels of adjacent hoistway doors, the two locationally fixed stopping dogs being vertically spaced from each other and arranged so that in each case one of the stopping dogs limits a horizontal opening movement of the barrier rail and thereby of the car door panel when a position of the elevator car deviates in a positive or negative vertical direction by a certain minimum distance from an intended stopping position;

wherein the stopping dogs are placed so that the hoistway door panel can be completely opened even though the elevator car takes up a position in which one stopping dog limits the opening movement of the barrier rail and of the car door panel as long as a coupling device that is to couple the hoistway door panel with the car door panel is no longer engaged.

2. The elevator system according to claim 1, wherein the locationally fixed stopping dogs are fastened to locationally fixed elements of the hoistway doors.

3. The elevator system according to claim 1, wherein the stopping dogs always have unchanged dimensions even with different story heights and door heights.

4. The elevator system according to claim 1, wherein at least one of the locationally fixed stopping dogs is provided with a T-shaped T-groove running in vertical direction;

wherein said at least one stopping dog is fastened to an element of the hoistway door by means of a bolt of which a bolt head is inserted in said T-groove, the bolt being pretensioned by means of a spring element so that said stopping dog is vertically moveable along said T-groove under influence of a defined vertical force.

5. An elevator system comprising:

an elevator hoistway;

a plurality of hoistway doors arranged above each other each with at least one horizontally moveable hoistway door panel;

an elevator car with a car door that has at least one horizontally movable car door panel;

a vertically extending barrier rail fastened to the car door panel; and, two locationally fixed stopping dogs in areas lying in a vertical direction between the hoistway door panels of adjacent hoistway doors, the two locationally fixed stopping does being vertically spaced from each other and arranged so that in each case one of the stopping dogs limits a horizontal opening movement of the barrier rail and thereby of the car door panel when a position of the elevator car deviates in a positive or negative vertical direction by a certain minimum distance from an intended stopping position;

wherein the locationally fixed stopping dogs are fastened to locationally fixed elements of the hoistway doors and always have unchanged dimensions even with different story heights and door heights.

6. An elevator system comprising:

an elevator hoistway;

a plurality of hoistway doors attached above each other each with at least one horizontally moveable hoistway door panel;

an elevator car with a car door that has at least one horizontally moveable car door panel;

a vertically extending barrier rail fastened to the car door panel; and two locationally fixed stopping dogs in areas lying in a vertical direction between the hoistway door panels of adjacent hoistway doors, the two locationally fixed stopping dogs being vertically spaced from each other and arranged so that in each case one of the stopping dogs limits and horizontal opening movement of the barrier rail and thereby of the car door panel when a position of the elevator car deviates in a positive or negative vertical direction by a certain minimum distance from an intended stopping position;

wherein the locationally fixed stopping dogs are fastened to locationally fixed elements of the hoistway doors and have a height that is not greater than 50 mm.

7. An elevator system comprising:

an elevator hoistway;

a plurality of hoistway doors arranged above each other each with at least one horizontally moveable hoistway door panel;

an elevator car with a car door that has at least one horizontally movable car door panel;

a vertically extending barrier rail fastened to the car door panel; and, two locationally fixed stopping dogs in areas lying in a vertical direction between the hoistway door panels of adjacent hoistway doors, the two locationally fixed stopping dogs being vertically spaced from each other and arranged so that in each case one of the stopping dogs limits a horizontal opening movement of the barrier rail and thereby of the car door panel when a position of the elevator car deviates in a positive or negative vertical direction by a certain minimum distance from an intended stopping position;

wherein the locationally fixed stopping dogs are fastened to locationally fixed elements of the hoistway doors and are placed so that the hoistway door panel can be completely opened even though the elevator car takes up a position in which one stopping dog limits the opening movement of the barrier rail and of the car door panel as long as a coupling device that is to couple the hoistway door panel with the car door panel is no longer engaged.

8. An elevator system comprising:

an elevator hoistway;

a plurality of hoistway doors arranged above each other each with at least one horizontally moveable hoistway door panel;

an elevator car with a car door that has at least one horizontally movable car door panel;

a vertically extending barrier rail fastened to the car door panel; and, two locationally fixed stopping dogs in areas lying in a vertical direction between the hoistway door panels of adjacent hoistway doors, the two locationally fixed stopping dogs being vertically spaced from each other and arranged so that in each case one of the stopping dogs limits a horizontal opening movement of the barrier rail and thereby of the car door panel when a position of the elevator car deviates in a positive or negative vertical direction by a certain minimum distance from an intended stopping position;

wherein the locationally fixed stopping dogs are fastened to locationally fixed elements of the hoistway doors and at least one of the locationally fixed stopping dogs is provided with a T-shaped T-groove running in the vertical direction; and wherein said at least one stopping dog is fastened to an element of the hoistway door by means of a bolt of which a bolt head is inserted in said T-groove, the bolt being pretensioned by means of a spring element so that said stopping dog is vertically moveable along said T-groove under influence of a defined vertical force.

* * * * *